US005579730A

United States Patent [19]

Trotter

[11] Patent Number: 5,579,730

[45] Date of Patent: Dec. 3, 1996

[54] ROTARY VALVE HEAD ASSEMBLY AND RELATED DRIVE SYSTEM FOR INTERNAL COMBUSTION ENGINES

[76] Inventor: Richard C. Trotter, 1006-0 Bent Tree La., Columbia, S.C. 29210

[21] Appl. No.: 599,072

[22] Filed: Feb. 9, 1996

[51] Int. Cl.[6] ..... F01L 5/04

[52] U.S. Cl. ..... 123/80 BA; 123/190.2; 123/190.17

[58] Field of Search ..... 123/190.1, 190.2, 123/190.16, 190.17, 80 BA

[56] References Cited

U.S. PATENT DOCUMENTS

| | | | |
|---|---|---|---|
| 396,022 | 1/1889 | Beckfeld . | |
| 1,118,975 | 12/1914 | Van Vleck . | |
| 1,213,873 | 1/1917 | Hollmann . | |
| 1,286,967 | 12/1918 | Eschwei . | |
| 4,010,727 | 3/1977 | Cross et al. | 123/190.17 |
| 4,279,225 | 7/1981 | Kersten | 123/190.5 |
| 4,333,427 | 6/1982 | Burillo et al. | 123/190.17 |
| 4,467,751 | 8/1984 | Asaka et al. | 123/190.17 |
| 4,714,063 | 12/1987 | Oda et al. | 123/190.2 |
| 5,154,147 | 10/1992 | Muroki | 123/190.17 |
| 5,205,251 | 4/1993 | Conklin . | |
| 5,309,876 | 5/1994 | Schiattino | 123/190.2 |
| 5,372,104 | 12/1994 | Griffin . | |
| 5,503,124 | 4/1996 | Wallis | 123/190.2 |

FOREIGN PATENT DOCUMENTS

WO83/00722 3/1983 WIPO .

*Primary Examiner*—Erick R. Solis
*Attorney, Agent, or Firm*—Richard C. Litman

[57] ABSTRACT

A rotary valve head assembly including a split head assembly, a rotary spool assembly, spool drive assemblies, and bearing and spool lubrication components. The split head assembly has bores for containing the spool assembly, bearings and spool seals, and defines passages for coolant and lubricant to pass therethrough. The head assembly is separable to provide unencumbered access to the components contained therein. The spool assembly is cylindrical and extends the length of the head assembly. The spool assembly has two ports for each combustion chamber. Each port is provided with a port relief to control the duration it is open. A separate and independent spool drive assembly provides each spool assembly rotating action. Each drive assembly effectively changes the timing of a corresponding spool assembly via instructions from the engine management system, allowing intake and exhaust timing can be controlled independently. The drive system simultaneously allows the engine to function as a compressor, thus providing an engine brake. The bearing and spool lubrication components provide support and lubrication for the spool assembly. Spring loaded lubricant control seals are mounted in the bearings and maintain contact with the spool assembly. The seals are also provided with a chamfer to control oil consumption while maintaining effective combustion chamber sealing. The instant invention eliminates the need for intake and exhaust valves and related actuation hardware, such as cams, lifters, rocker arms, and pushrods.

8 Claims, 6 Drawing Sheets

ROTARY VALVE HEAD ASSEMBLY AND RELATED DRIVE SYSTEM FOR INTERNAL COMBUSTION ENGINES

BACKGROUND OF THE INVENTION

1. FIELD OF THE INVENTION

The present invention relates generally to internal combustion engines and more particularly to a particular piston and enclosing cylinder construction for internal combustion engines. The present invention specifically relates to a rotary valve head assembly and related drive system for internal combustion engines.

2. DESCRIPTION OF THE PRIOR ART

Rotary valve configurations are well known in prior art and are used in various forms in internal combustion engines. Rotary valves are favored over poppet valve arrangements because they have a potential for unobstructed flow, providing intake and exhaust efficiencies which exceed those of the most sophisticated multi-valve poppet arrangements.

An example of a rotary valve configuration is set forth U.S. Pat. No. 1,118,975 issued Dec. 1, 1914 to Horrace Russ Van Vleck. This configuration includes a casing having a bore on both the intake side and the exhaust side. The intake bore is provided with an inlet valve comprising two valve members. One of these valve members is a sleeve which fits snugly in the intake bore and rotates freely therein. The other valve member fits snugly in the sleeve and rotates freely therein. In the exhaust bore is provided an exhaust valve. The three rotary valve members are connected by a suitable gear arrangement to the crankshaft. In accordance with this gear arrangement, the intake sleeve and the exhaust valve are rotated at one-quarter the speed of the crank shaft and the intake valve is rotated at three-quarters the speed of the crank shaft. This effects sufficient intake passage for ample supply of gas and permits the intake passage to remain open through a substantial portion of the downward stroke of the piston. To ensure proper lubrication of the intake valve sleeve and valve, the sleeve is provided with radial openings therethrough to permit passage of lubricant to the valve; the valve is further provided with depressions therein to receive and hold and aid in distributing a lubricant over the surface of the valve.

U.S. Pat. No. 1,213,873 issued Jan. 30, 1917 to George E. Hollmann shows and describes another rotary valve configuration. This rotary valve configuration includes tubular valve casings and tubular valve sleeves that fit within the valve casings. Each casing has a chambered core extending therethrough which affords a bearing for a corresponding valve sleeve. The core has two chambers, one serving as a space for cooling water, and the other for conducting combustible mixture. The valves have a running fit between corresponding valve casings and cores, having ports which open corresponding cylinder ports when registered therewith. Each valve extends at one end beyond its casing and has fixed thereon a gear wheel that meshes with a driving gear. The driving gear is driven by the crankshaft.

Another rotary valve configuration is provided in U.S. Pat. No. 1,286,967 issued Dec. 10, 1918 to Henry Eschwei. This configuration includes a casting having longitudinally disposed bores within which rotatable valves are positioned. The valves are provided with spiral grooves for carrying lubricants which lubricate the exterior surface of the valve. The valves are driven by a worm wheel arrangement connected to a vertical shaft which is in turn connected to the crankshaft via a beveled gear arrangement.

U.S. Pat. No. 5,205,251 issued Apr. 27, 1993 to Ronald J. Conklin Yet provides yet another rotary valve. This rotary valve comprises a cylindrical valve body rotatably displaceable within a valve sleeve. The valve sleeve is rotatably disposed within the head of an internal combustion engine. Both intake and exhaust functions have a rotary valve. Under normal operations, the valve sleeves and body rotate at the same speed, opening intake and exhaust ports at appropriate times. Advancing or retarding valve timing is accomplished by varying the rotational velocity of either the valve body or the valve sleeve which in turn rotates the valve sleeve relative to the valve body to either advance or retard the appropriate port.

Still another rotary valve arrangement is set forth in U.S. Pat. No. 5,372,104 issued Dec. 13, 1994 to Bill E. Griffin. This arrangement employs valve body rotatably disposed within a valve sleeve. Sealing members and rings inset into a valve rotor and which encircle the valve rotor. Only the sealing members and rings contact the inner surface of the valve sleeve and thus prevent the valve rotor from contacting the valve sleeve. The sealing members are spring biased to ensure that the sealing members maintain contact with the inner surface of the valve sleeve.

The present invention is distinguished from the aforementioned rotary valve configurations in that it is not comprised of two valve members but rather is a single valve spool, that is, it does not employ a valve sleeve. Moreover, the instant invention provides a valve drive assembly which permits advancing or retarding intake and exhaust valves independently, something which cannot be accomplished by inventions of the prior art. It should also be noted that the instant invention does not have sealing members or rings inset in the valve spool.

None of the above inventions and patents, taken either singly or in combination, is seen to describe the instant invention as claimed.

SUMMARY OF THE INVENTION

The present invention a rotary valve head assembly and related drive system for internal combustion engines. The rotary valve head assembly includes a split head assembly, a rotary spool assembly, spool drive assemblies, and bearing and spool lubrication components.

The head assembly has bores therein for containing the rotary spool assembly, bearings and spool seals, and passages for coolant and lubricant to pass therethrough. To provide unencumbered access to the rotating parts contained therein, the head assembly is separable.

The rotary spool assembly is cylindrical and extends the length of the head assembly. The spool assembly has two ports for each combustion chamber. Rotation of the spool assembly opens and closes each port with proper timing of the crankshaft. The ports are provided with port reliefs. These port reliefs control the duration in which the ports are open relative. Configuring the port reliefs so as to keep the ports open longer accomplishes the same effect as larger valves or cams with longer lift duration. By varying the port slope, the air flow characteristics of the head can be varied. Moreover, intake and exhaust spools can be configured with different port slopes, depending on performance requirements.

The spool drive assembly provides the spool assembly with rotating action. The spool assemblies may be driven by high speed gear belt, gear train, or other suitable configuration. The drive assembly includes a planetary drive assembly comprising a ring gear, planet gears and associated shafts, and a sun gear. The planet gear shafts are mounted in the rotary spool assembly. A spool drive support and sun gear bearing provide support for the spool drive assembly through engagement of planet gears supported by respective planet gear shafts and sun gear. A spool drive seal provides a seal between the ring gear and valve spool.

During operation, a drive belt drives the ring gear which in turn drives the planet gears which in turn rotates about the sun gear. The position of the sun gear is fixed by an actuator and lock assembly. This configuration provides and maintains the proper timing of the spool assembly relative to the crank shaft and other spool assemblies. Movement of the sun gear effectively changes the timing of the affected spool assembly. Movement of the sun gear is controlled by an electronic activator and lock that receives instructions from the engine management system (EMS). The EMS provides the electronic actuator and Lock assembly with instructions whether to advance or retard the spool assembly. A spool position sensor provides the EMS with information regarding the position of the spool assembly ports relative to the crank shaft. Since each spool assembly is controlled independently by its own corresponding actuator and lock assembly, intake and exhaust timing can be controlled independently. Advancing and retarding the spool assembly effectively changes engine performance by optimizing intake charge timing and exhaust timing. This has the same effect as changing the camshaft lobe profile, allowing the engine to perform more efficiently over a broader range of revolutions per minute (RPM).

The planetary drive system simultaneously also allows the engine to function as a compressor, thus providing an engine brake. This is accomplished by advancing the exhaust spool and retarding the intake spool, or vice versa. This feature provides a brake system to supplement conventional brake systems, thus enhancing vehicle safety.

The bearing and spool lubrication components provide support and lubrication for the spool assembly. The lubricant control spool seals are mounted in the bearings and are spring loaded so as to maintain contact with the spool assembly. The spool seals are provided with a chamfer for effectively controlling oil consumption while maintaining effective combustion chamber sealing. Each chamfer drains oil back to the oil sump through the main galley in order to channel oil away from the spool assembly to prevent the spool seals from hydroplaning on oil film and losing contact with the spool assembly.

Accordingly, it is a principal object of the invention to provide a rotary valve head assembly and related drive system for internal combustion engines.

It is another object to provide a rotary valve head assembly which includes a split head assembly which is separable to provide unencumbered access to the rotating parts contained therein.

It is a further object to provide a rotary valve assembly which includes a rotary spool assembly having ports provided with port reliefs to control the duration that the ports are open, whereby air flow characteristics of the head may be varied by varying the slope of the port reliefs.

Still another object is to provide a spool drive assembly which provides and maintains the proper timing of the rotary spool assembly.

Another object that timing of the rotary spool assembly be changed independently of other rotary spool assemblies via the drive assembly, thus permitting independent control of intake and exhaust timing.

A further object is that the drive assembly be controlled by instructions from the engine management system (EMS).

Another object is that the instant invention simultaneously allows the engine to function as a compressor, thus providing an engine brake which may supplement conventional brake systems and enhance vehicle safety.

Yet another object is to provide a rotary valve head assembly having bearing and spool lubrication components including spool seals which are also spring loaded so as to maintain contact with the rotary spool assembly.

It is a further object that the spool seals be provided with a chamfer to effectively control oil consumption while maintaining effective combustion chamber sealing.

It is another object that the spool seal chamfers channel oil away from the rotary spool assembly to prevent the spool seals from hydroplaning on oil film and losing contact with the rotary spool assembly.

Still another object is that both intake and exhaust to be on separate spools or on the same rotary spool assembly, depending on performance requirements.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention a rotary valve head assembly and related drive system for internal combustion engines. Although the following description is in respect to a separate rotary valve spool for the intake and exhaust sides, a single rotary valve spool may include both intake and exhaust ports.

Figure 1:
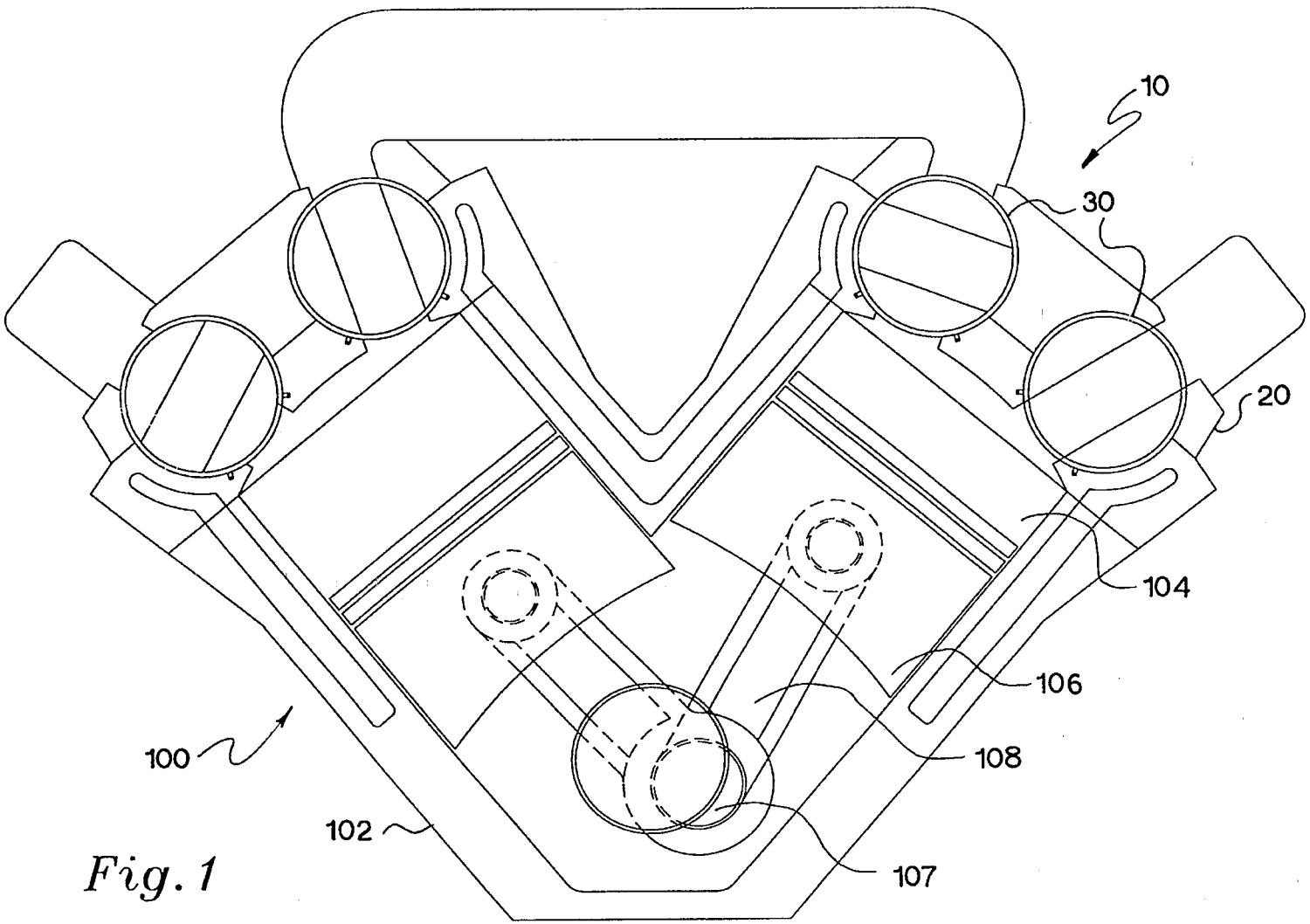
FIG. 1 is a section view of an internal combustion engine and rotary valve head assembly.

Now, with reference to the drawings, FIG. 1 shows a rotary valve head assembly 10 and internal combustion engine 100. The internal combustion engine 100 comprises a casing 102 having bores therein forming cylinders 104. The cylinders 104 receive pistons 106. The pistons 106 are connected to the crank shaft 107 by pistons rods 108. Rotary valve head assemblies 10 are mounted to the engine casing 102. Each valve head assembly 10 includes a split head assembly 20, a rotary spool assembly 30, spool drive assembly 40 (shown in FIGS. 4 and 5), and bearing and spool lubrication components 50 (shown more clearly in FIG. 6). Because the operation of intake and exhaust sides are mechanically the same differing only in their timing, only the intake side is described below.

Figure 2:
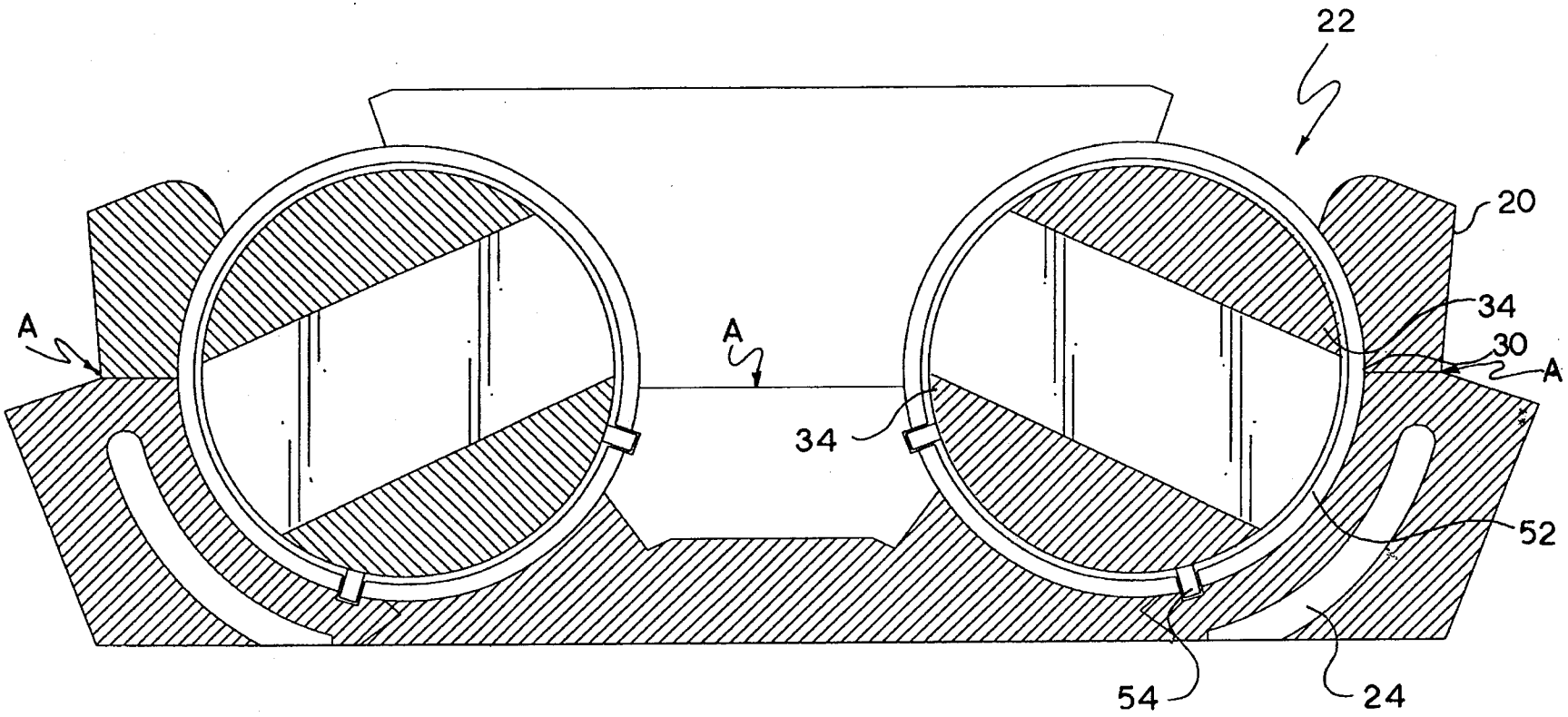
FIG. 2 is a section view of the rotary valve head assembly shown in FIG. 1.

Referring now to FIG. 2, the split head assembly 20 has bores 22 therein for containing the rotating components, namely, the rotary spool assembly 30, bearings 52 and coated lubricant control spool seals 54, preferably Teflon® coated. The head assembly 20 further has passages therein which permit coolant and lubricant to pass therethrough. To provide unencumbered access to the rotating parts contained therein, the head assembly 20 is diametrically separable, such as along the line A—A. The head assembly 20 may be fabricated of aluminum, steel or other suitable materials.

Figure 3:
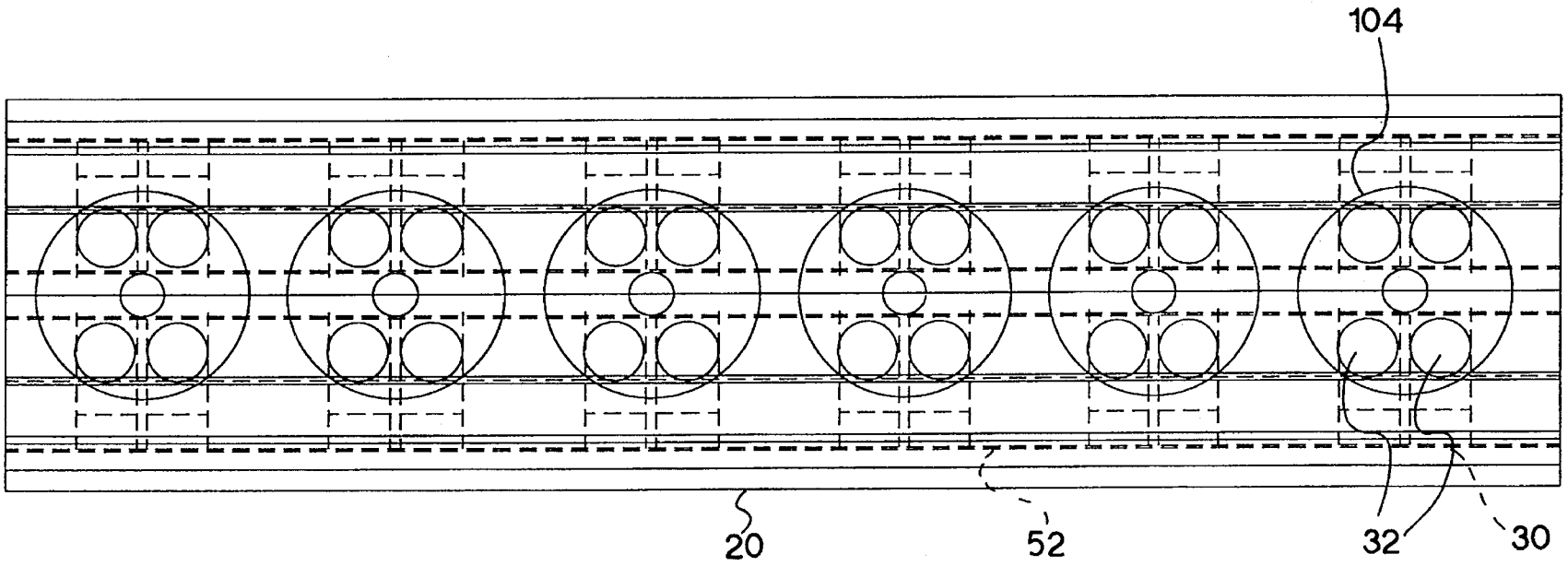
FIG. 3 is a plan view of the rotary valve head assembly shown in FIG. 1.

The rotary spool assembly 30 is a cylindrical part that extends the length of the head assembly 20. The spool assembly 30 has two bores defining two ports 32 for each combustion chamber, as is clearly shown in FIG. 3. The rotation of the spool assembly 30 opens and closes each intake port with proper timing of the crankshaft 107. Since the spool assembly 30 opens and closes the intake port 26 twice per revolution, the spool assembly 30 rotates at one quarter of the rate of the crankshaft 107. The operation of the spool assembly 30 for each combustion chamber is mechanically the same. Only the timing is different. Hence, a description of the spool assembly 30 regarding only one combustion chamber is described hereinafter. The spool assembly 30 may be fabricated of steel, preferably Teflon® coated steel, titanium or possibly aluminum.

The spool assembly ports 32 are provided with port reliefs 34. The port reliefs 34 control the duration over which the ports 32 are open. Depending on the port slope, the air flow characteristics of the head could be changed. Moreover, intake and exhaust valve spool assemblies can be configured with different port slopes, depending on performance requirements.

Figure 4:
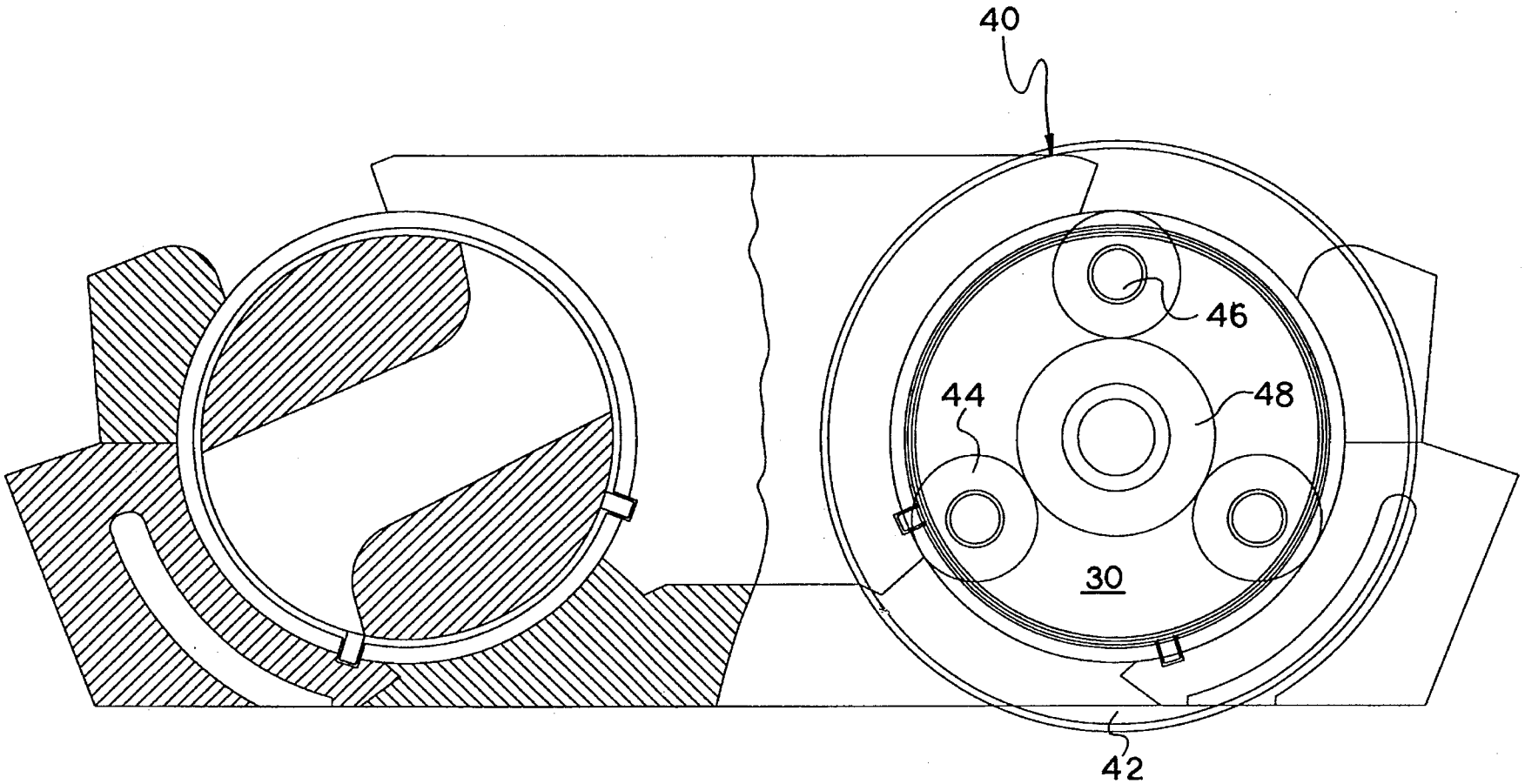
FIG. 4 is a partial section view of the rotary valve head assemble with spool drive assembly shown in full.
Figure 5:
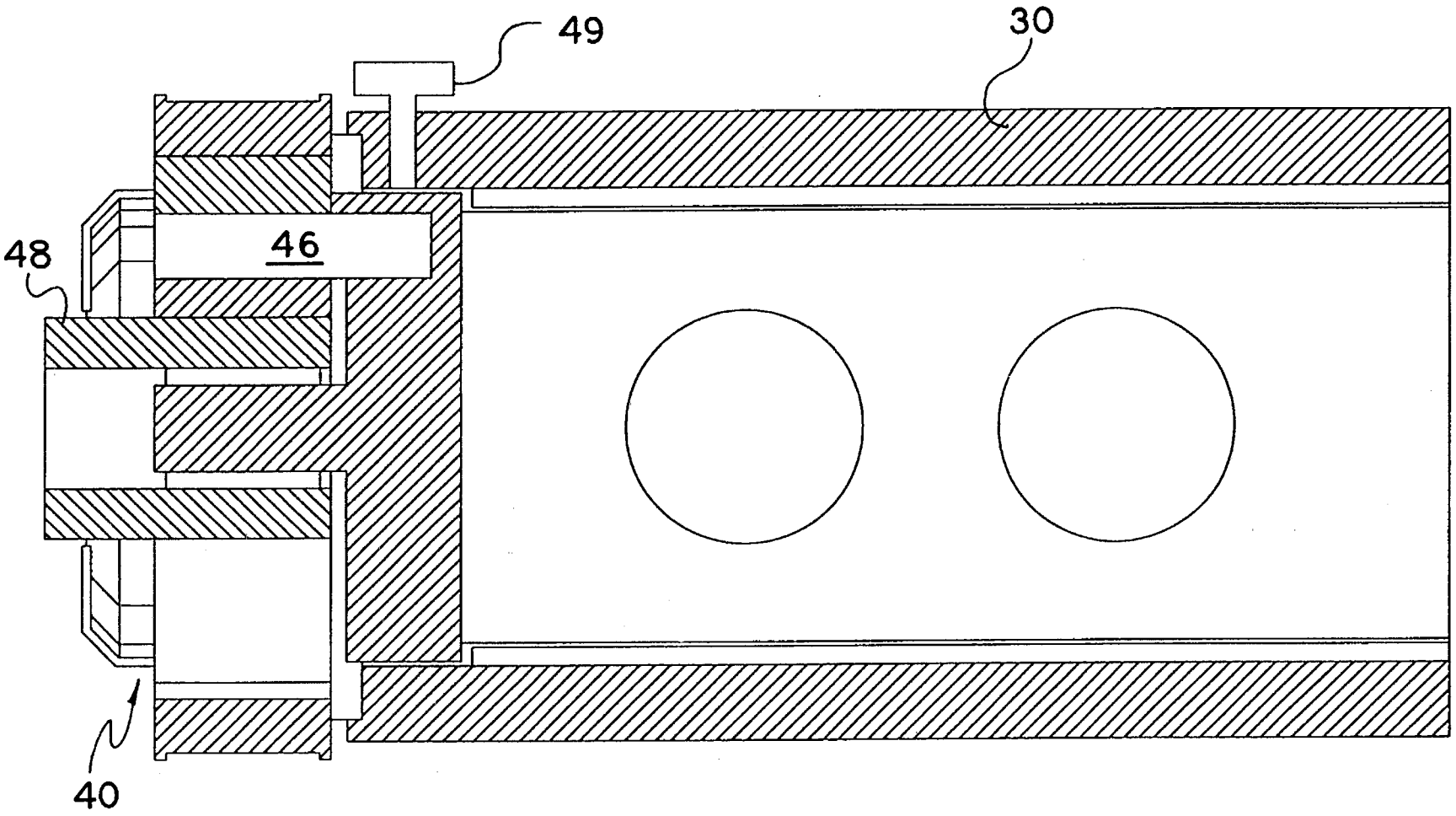
FIG. 5 is a section view of the rotary valve head assembly spool drive assembly drawn along lines 5—5 of FIG. 4.

With reference to FIGS. 4 and 5, the spool drive assembly 40 provides the spool assembly 30 with rotating action. The spool assemblies 30 may be driven by high speed gear belt, gear train, or other suitable configuration. Again, although intake and exhaust spool assemblies are driven independently, the operation of each spool drive assembly is mechanically the same. Hence, a complete drive assembly for only one rotary spool assembly is described hereinbelow.

The rotating power is provided for the spool assembly 30 by the spool drive assembly 40. This drive assembly 40 is a planetary drive assembly comprising: a ring gear 42 having a belt raceway; three sets of planet gears 44 and associated shafts 46; and a sun gear 48. The planet gear shafts 46 are mounted in the spool assembly 30 to couple the planet gears 44 to the spool assembly 30. The sun gear 48 supported by a sun gear support bearing which in turn is carried by spool drive support 41 with in turn is coupled to the spool assembly 30. The crankshaft 107 is coupled to the ring gear 42 via a drive belt (not shown). The ring gear 42 in turn meshes with the planet gears 44 which mesh with the sun gear 48. This configuration provides support for the drive assembly 40 through engagement of planet gears 44 supported by respective planet gear shafts 46, and sun gear 48.

During operation, a drive belt drives the ring gear 42 which in turn drives the planet gears 44 which in turn rotates about the sun gear 48. The position of the sun gear 48 is fixed by an actuator and lock assembly on front of the gear 48 (not shown). This configuration provides and maintains the proper timing of the spool assembly 30 relative to the crank shaft 107 and other rotary spool assemblies, e.g. the exhaust spool assembly. Movement of the sun gear 48 effectively changes the timing of the affected spool assembly 30. Movement of the sun gear 48 is controlled by the actuator and lock assembly. The actuator is an electronic actuator that receives instructions from the engine management system (EMS). The EMS monitors environmental inputs, such as ambient temperature, barometric pressure and humidity. The EMS also monitors performance aspects, such as throttle position, boost pressure, exhaust gas temperature, spool position and gear selection. Based on these variables, the EMS provides the electronic actuator and lock assembly with instructions whether to advance or retard the spool assembly 30. The spool position sensor 49 provides the EMS with information regarding the position of the spool assembly ports 32 relative to the crank shaft 107. Since each rotary spool assembly may be controlled independently by a corresponding actuator and lock assembly, intake and exhaust timing can be controlled independently. Hence, advancing and retarding corresponding rotary spool assemblies 30 may effectively change engine performance by optimizing intake charge timing and exhaust timing.

The drive system 40 also allows the engine to simultaneously function as a compressor and thus provide an engine brake. This is accomplished by advancing the exhaust spool and retarding the intake spool, or vice versa. This feature provides a brake system to supplement conventional systems and thus enhance vehicle safety.

Figure 6:
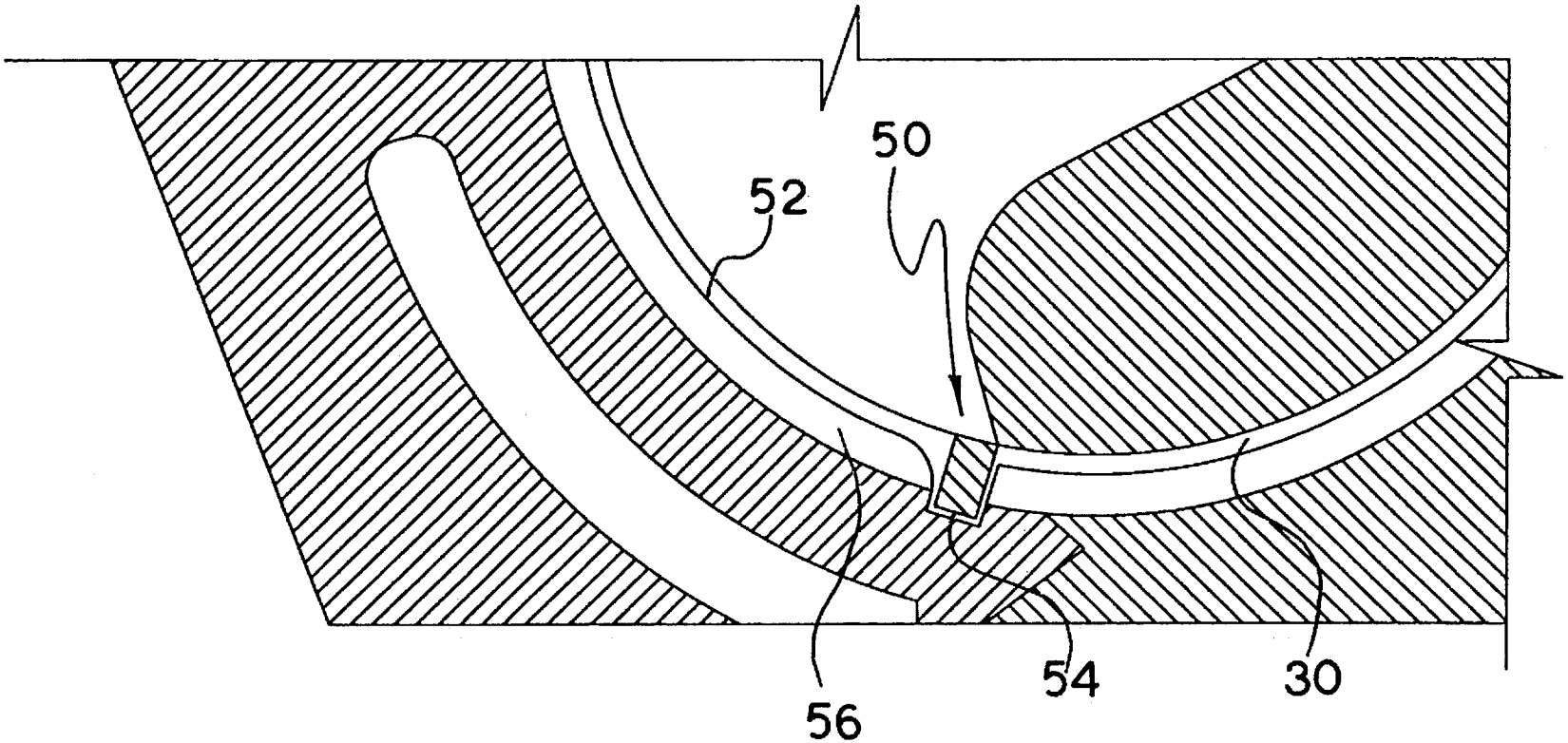
FIG. 6 is an enlarged elevational view of a seal and seal chamfer.

Now referring to FIG. 6, the bearing and spool lubrication components 50 provide support and lubrication for the spool assembly 30. The bearings 52 may be bronze or steel backed aluminum with lead or tin overlay. Lubricant control spool seals 54 mounted in the bearings may be fabricated of steel, preferably Teflon® coated steel, and are spring loaded so as to maintain contact with the spool assembly 30. The spool seals 54 are provided with a chamfer 56 for effectively controlling oil consumption while maintaining effective combustion chamber sealing. The chamfers 56 channel oil away from the spool assembly 30 to prevent the spool seals 54 from hydroplaning on oil film and loosing contact with the spool assembly 30. This is accomplished because the chamfers 56 drain oil back to the oil sump through the main galley.

Although the invention has been described with respect to separate spool assemblies 30 for intake and exhaust sides, it is possible for both intake and exhaust ports to be provided on the same spool assembly, depending on desired performance requirements.

It should also be noted that fabrication of the components is not limited to the materials described above, but rather the components may be fabricated of any material suitable to meet performance, application and economic requirements.

It is to be understood that the present invention is not limited to the sole embodiment described above, but encompasses any and all embodiments within the scope of the following claims.

I claim:

1. A rotary valve head assembly and rotary valve drive system for an internal combustion engine comprising a casing having a bore therein defining a cylinder, a piston received by the cylinder, a crankshaft, a piston rod connecting the crankshaft to the piston, and an engine management system, said rotary valve head assembly and rotary valve drive system comprising:

a split head assembly having a bore therein, and having a passage for coolant and lubricant to pass therethrough, said split head assembly being diametrically separable;

a cylindrical rotary spool assembly extendable the length of said split head assembly and having two bores defining two ports provided with port reliefs, said rotary spool assembly tightly fitting within said bore in said split head; and bearings and spool seals mounted in said bearings, said spool lubrication control seals being spring loaded so as to maintain contact with said valve spool assembly, said spool seals further provided with a chamfer; and a spool drive assembly including a planetary drive assembly comprising:

a ring gear having a belt raceway, said ring gear coupled to the crankshaft by a drive belt;

three planet gears and mating planet gear shafts, each said planet gear coupled to said valve spool assembly by a respective one of said planet gear shafts, said three planet gears meshing with said ring gear; and a sun gear and a spool drive support, said sun gear coupled to said valve spool assembly by said spool drive support, said sun gear meshing with said planet gears.

2. The rotary valve head assembly and rotary valve drive system according to claim 1, further comprising means for affecting movement of said sun gear to effectively change timing of said valve spool assembly.

3. The rotary valve head assembly and rotary valve drive system according to claim 2, said means for affecting movement including an electronic actuator that receives instructions from the engine management system.

4. The rotary valve head assembly and rotary valve drive system according to claim 3, further including a spool position sensor to provide the engine management system with information regarding the position of the spool assembly ports relative to the crank shaft.

5. An internal combustion engine comprising:

a casing having a bore therein defining a cylinder;

a piston received by said cylinder;

a crankshaft;

a piston rod connecting said crankshaft to said piston;

an engine management system; and a rotary valve head assembly comprising:

a split head assembly having a bore therein, and having a passage for coolant and lubricant to pass therethrough, said split head assembly being diametrically separable;

a cylindrical rotary spool assembly extendable the length of said split head assembly and having two bores defining two ports provided with port reliefs, said rotary spool assembly tightly fitting within said bore in said split head; and bearings and spool seals mounted in the bearings, said spool lubrication control seals being spring loaded so as to maintain contact with said valve spool assembly, said spool seals further provided with a chamfer; and a spool drive assembly including a planetary drive assembly comprising:

a ring gear having a belt raceway, said ring gear coupled to the crankshaft by a drive belt;

three planet gears and mating planet gear shafts, each said planet gear coupled to said valve spool assembly by a respective one of said planet gear shafts, said three planet gears meshing with said ring gear; and a sun gear and a spool drive support, said sun gear coupled to said valve spool assembly by said spool drive support, said sun gear meshing with said planet gears.

6. The rotary valve head assembly and rotary valve drive system according to claim 5, further comprising means for affecting movement of said sun gear to effectively change timing of said valve spool assembly.

7. The rotary valve head assembly and rotary valve drive system according to claim 6, said means for affecting movement including an electronic actuator that receives instructions from the engine management system.

8. The rotary valve head assembly and rotary valve drive system according to claim 7, further including a spool position sensor to provide the engine management system with information regarding the position of the spool assembly ports relative to the crank shaft.

* * * * *